US007609845B2

(12) United States Patent
Chang

(10) Patent No.: US 7,609,845 B2
(45) Date of Patent: Oct. 27, 2009

(54) HANGING TYPE EARPHONE

(75) Inventor: Yu-Chao Chang, Taipei (TW)

(73) Assignee: Microlink Communications Inc., Taipei (TW)

( * ) Notice: Subject to any disclaimer, the term of this patent is extended or adjusted under 35 U.S.C. 154(b) by 785 days.

(21) Appl. No.: 11/367,478

(22) Filed: Mar. 6, 2006

(65) Prior Publication Data

US 2007/0217643 A1 Sep. 20, 2007

(51) Int. Cl.
*H04R 25/00* (2006.01)

(52) U.S. Cl. ..... 381/381; 381/370; 381/374

(58) Field of Classification Search ..... 381/330, 381/370, 374, 376, 378, 379, 381; 181/129, 181/135; 379/430, 420.02, 433.02; 455/569.1, 455/575.1

See application file for complete search history.

(56) References Cited

U.S. PATENT DOCUMENTS 6,707,923 B2 * 3/2004 Pronk ..... 381/374
7,106,877 B1 * 9/2006 Linville ..... 381/381
2002/0106100 A1 * 8/2002 Kao ..... 381/381
2007/0172091 A1 * 7/2007 Tsai et al. ..... 381/381

* cited by examiner

*Primary Examiner*—Huyen D Le
(74) *Attorney, Agent, or Firm*—Rosenberg, Klein & Lee

(57) ABSTRACT

A hanging type earphone includes an earphone body and an ear hook. The earphone body has a speaking portion and a first connecting portion thereon. A pair of polygonal prisms is disposed at opposite ends of the first connecting portion. The ear hook is shaped to fit a shape of ears and pivotally mounted to the earphone body for hanging the earphone body on an ear. The ear hook has a second connecting portion shaped as a bridge with a pair of piers disposed there-beneath. The pair of piers each defines a polygonal hole. The second connecting portion rides on the first connecting portion with the polygonal prisms inserted into the respective polygonal holes. A wall of each polygonal hole is at least partially split so that the polygonal hole is enlargeable to enable the polygonal prism to pivot therein.

4 Claims, 3 Drawing Sheets

HANGING TYPE EARPHONE

BACKGROUND OF THE INVENTION

1. Field of the Invention

The present invention relates to a hanging type earphone, and more particularly, to a hanging type earphone having adjustable and positionable mechanism.

2. The Related Art

At present, a mobile phone has become an indispensable device for a user to conveniently communicate, and correspondingly, personal earphones for the mobile phone, also commonly known as headphones, ear sets, headsets, and the like, are gaining in popularity. It is important that the main body of the earphone securely positions its components in their proper places with respect to the wearer, without being unduly loose and without causing discomfort to the wearer.

A hanging type earphone is a typical earphone for the mobile phone. Referring to U.S. Pat. Pub. No. 2002/0106100, a conventional hanging type earphone disclosed in the patent includes an earphone body and an ear hook mounted on the earphone body for hanging the earphone body on an ear of a wearer. The earphone body has a connecting track formed as a sealing teeth shape track for pivotally and slidably connecting the ear hook. The connecting track defines some confined positions so as to adjust the distance between the ear hook and the earphone body. At each confined position, the ear hook can freely rotate horizontally by a shaft so as to adjust the angle between the ear hook and the earphone body. By adjusting the angle and the distance between the ear hook and the earphone body, the wearer can find a comfortable position to fit his/her ear.

However, in this type of mount structure mentioned above, the rotating ear hook relative to the earphone body is relatively unrestrained. That is, the adjusted angle between the ear hook and the earphone body may be easily transformed into other angles in which the wearer will feel unreliable and uncomfortable.

SUMMARY OF THE INVENTION

Accordingly, an object of present invention is to provide a hanging type earphone with adjustable and positionable function. The hanging type earphone includes an earphone body and an ear hook. The earphone body has a speaking portion and a first connecting portion thereon. A pair of polygonal prisms is disposed at opposite ends of the first connecting portion. The ear hook is shaped to fit a shape of ears and pivotally mounted to the earphone body for hanging the earphone body on an ear. The ear hook has a second connecting portion shaped as a bridge with a pair of piers disposed there-beneath. The pair of piers each defines a polygonal hole. The second connecting portion rides on the first connecting portion with the polygonal prisms inserted into the respective polygonal holes. A wall of each polygonal hole is at least partially split so that the polygonal hole is enlargeable to enable the polygonal prism to pivot therein.

Constructed as mentioned-above, the present hanging type earphone can adjust the angle between the earphone body and the ear hook by pivotal movement of the ear hook. Furthermore, the engagement between the polygonal prism and the polygonal hole enables the ear hook to be rested on several positions. That is, the hanging type earphone can be adjusted and positioned. Therefore, wearers can enjoy the hanging type earphone in a comfortable and reliable position.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
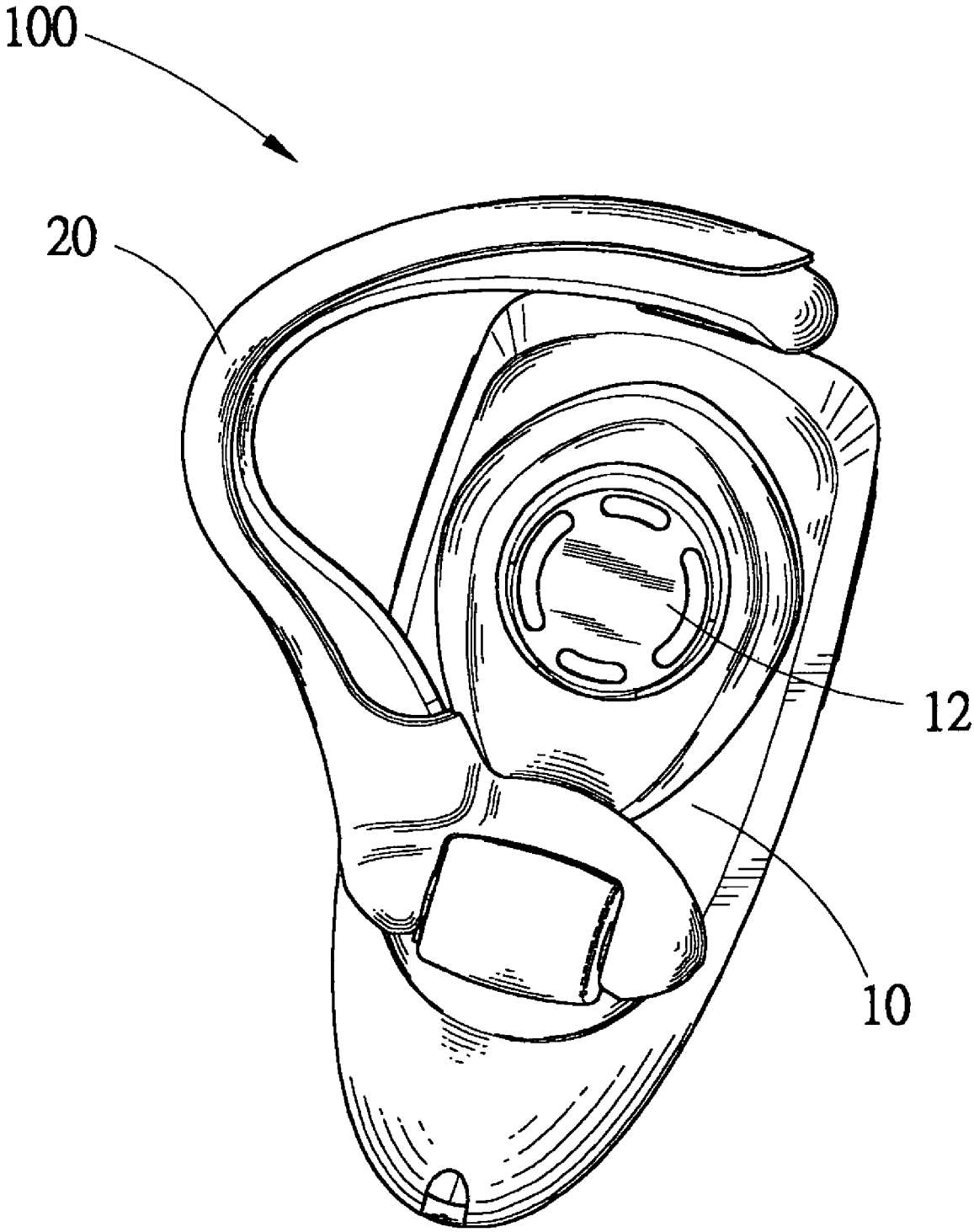
FIG. 1 is a perspective view of a hanging type earphone according to the present invention.

Please refer to FIG. 1. A hanging type earphone 100 according to the present invention is illustrated. The hanging type earphone 100 has an earphone body 10 and an ear hook 20 pivotally mounted onto the earphone body 10 for hanging the earphone body 10 on an ear of a wearer.

Figure 2:
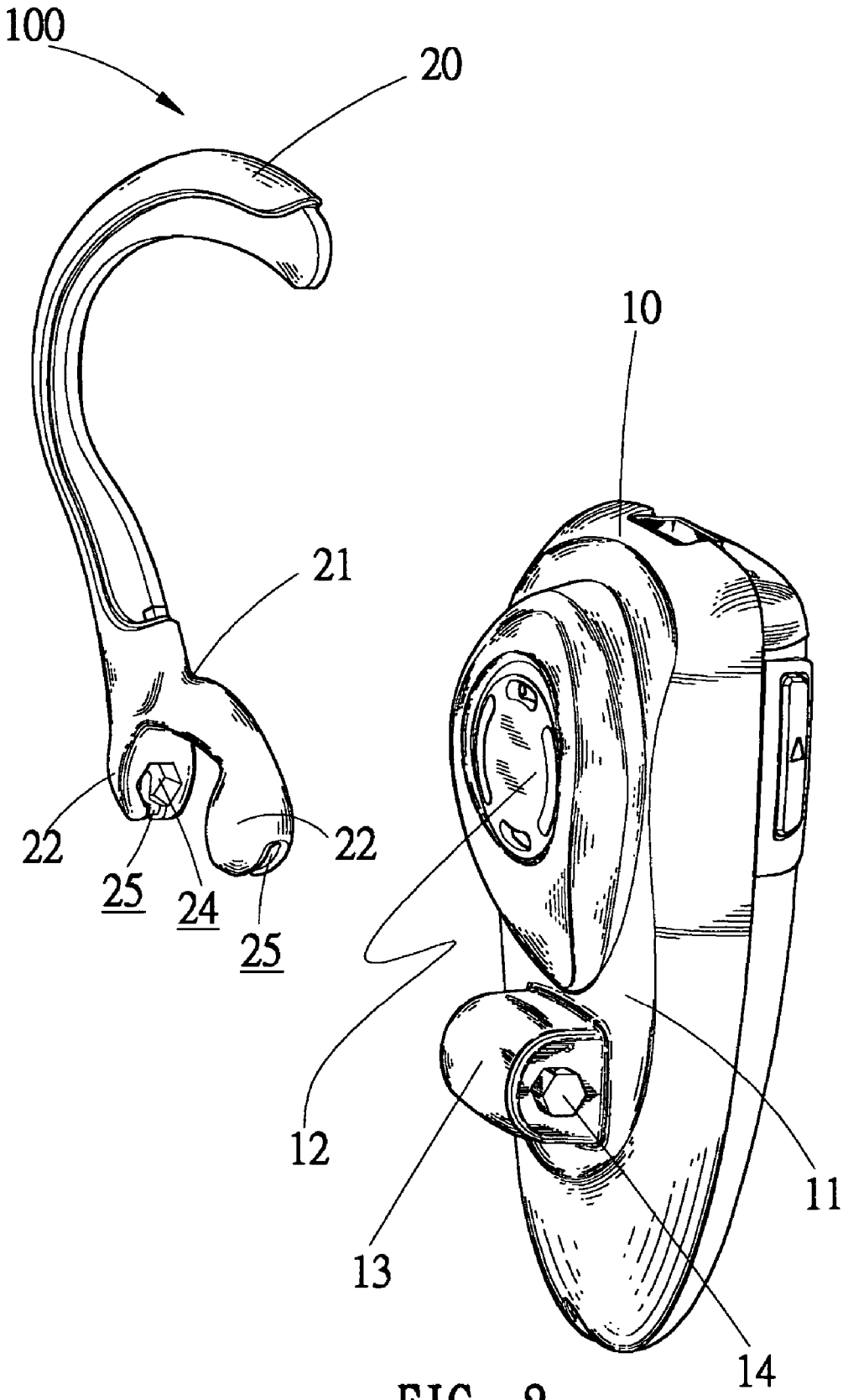
FIG. 2 is an exploded view of the hanging type earphone as shown in FIG. 1.

Please refer to FIG. 2. The earphone body 10 is equipped with audio signals processing components (not shown) therein to receive and transmit audio signals and a speaker (not shown) therein. The earphone body 10 has an out surface 11. A speaking portion 12 is formed on the out surface 11 corresponding to the speaker. The speaking portion 12 and the speaker are disposed on/in the earphone body 10 at a position with respect to the ear cavity of the wearer. A first connecting portion 13 is formed below the speaking portion 12 on the out surface 111. The first connecting portion 13 formed as a block is integrally molded with the earphone body 10. The first connecting portion 13 has two lateral polygonal prisms 14 disposed at opposite ends of the first connecting portion 13. The two lateral polygonal prisms 14 (the left prism not shown) are integrally molded portions of the first connecting portion 13. In the preferred embodiment, the polygonal prisms 14 are hexagonal prisms.

Figure 3:
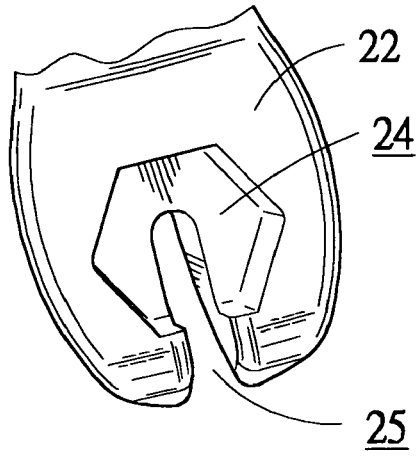
FIG. 3 is a partial enlarged view of the hanging type earphone showing a pier and a polygonal hole thereof in more detail.

With reference to FIG. 2 and FIG. 3, the ear hook 20 is approximately C-shaped for fitting ear shape of the wearer. The ear hook 20 has an end acting as a second connecting portion 21. The second connecting portion 21 is formed as a bridge shape from elastomeric material. The second connecting portion 21 has two piers 22 disposed there-beneath. Each pier 22 defines a polygonal hole 24 therein for containing the corresponding polygonal prism 14. A wall of the each polygonal hole 24 is partially split to form a split 25. The split 25 communicates with the polygonal hole 24. In the preferred embodiment, the polygonal holes 24 are hexagonal holes for engaging with the hexagonal prisms.

Figure 4:
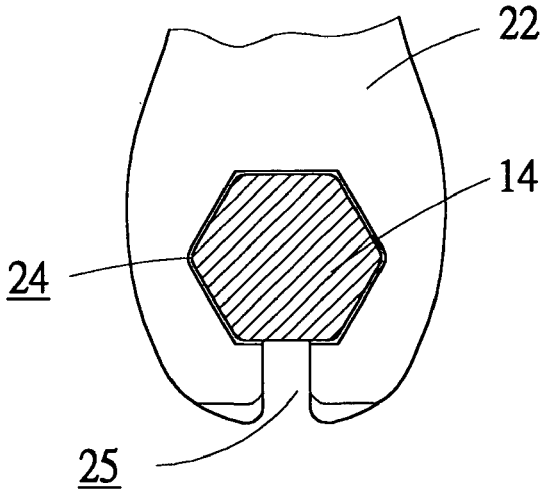
FIG. 4 is a schematic view showing a hexagonal prism and the polygonal hole are engaged in a first position where the hexagonal prism is rested on a confined position.
Figure 5:
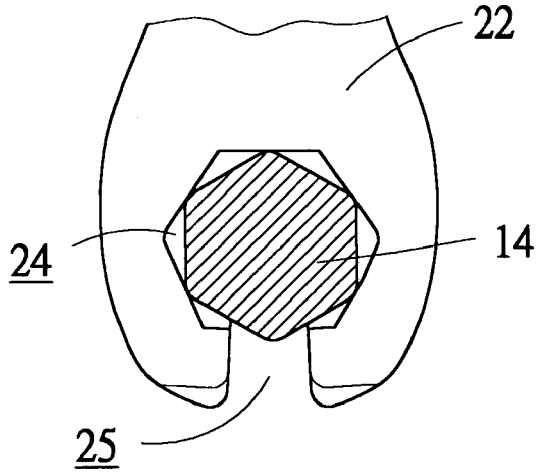
FIG. 5 is a schematic view showing the hexagonal prism and the polygonal hole are engaged in a second position where the polygonal hole is enlarged.

With reference to FIGS. 1, 4 and 5, in assembly, the second connecting portion 21 rides on the first connecting portion 13 with the polygonal prisms 14 being inserted into the respective polygonal holes 24. On one hand, because the each pier 22 is partially split, the polygonal hole 24 is enlargeable to enable the polygonal prism 14 to pivot in the polygonal hole 24. On the other hand, the engagement between the polygonal prism 14 and the polygonal hole 24 enables the ear hook 20 to be rested on several positions. That is, when an accidental smaller force is acted on the ear hook 20, the rotation of the ear hook 20 is relatively restrained in a confined position in which outer surfaces of the polygonal prism 14 respectively attach to inner surfaces of the polygonal hole 24 (shown in FIG. 4). While when an intentional larger rotating force is acted on the ear hook 20, the polygonal hole 14 is enlarged to permit the polygonal prism 14 to pivot therein (shown in FIG. 5).

Please refer to FIG. 2 in conjunction with FIG. 1, the assembling of the hanging type earphone 100 is very convenient. Firstly, one of the polygonal prisms 14 is infixed into one corresponding polygonal hole 24. Thereafter or simultaneously, the other polygonal prism 14 is snap-infixed in the other corresponding polygonal hole 24.

To wear the hanging earphone 100, firstly, a wearer acts a rotating force on the ear hook 20 to rotate the polygonal prism 14 to a confined position. Then hang the ear hook 20 on the ear of the wearer. If needed, the wearer acts an adjusting force on the ear hook 20 to rotate the polygonal prism 14 to another confined position in which the angle between the ear hook 20 and the ear body 10 makes the wearer feel comfortable and reliable to support the hanging type earphone 100 around his/her ear.

It will be appreciated that, alternatively, the embodiment above can be modified to swap the positions of the polygonal prisms 14 and the polygonal holes 24. It will be also appreciated that, alternatively, the polygonal prisms 14 can use other shapes, such as square prism, pentagonal prism, etc. It will be further appreciated that the polygonal hole 24 can be modified to accommodate these alternate shapes.

Although preferred embodiments of the present invention have been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A hanging type earphone comprising:

an earphone body having a speaking portion and a first connecting portion thereon, a pair of polygonal prisms being disposed at opposite ends of said first connecting portion; and an ear hook shaped to fit a shape of ears and pivotally mounted to said earphone body for hanging said earphone body on an ear, said ear hook having a second connecting portion shaped as a bridge with a pair of piers disposed there-beneath, the pair of piers each defining a polygonal hole, said second connecting portion riding on said first connecting portion with said polygonal prisms inserted into said respective polygonal holes, a wall of each polygonal hole being at least partially split so that the polygonal hole is enlargeable to enable said polygonal prism to pivot therein.

2. The hanging type earphone as claimed in claim 1, wherein said polygonal prism is hexagonal prism, and said polygonal hole is hexagonal hole.

3. The hanging type earphone as claimed in claim 1, wherein said first connecting portion is an integrally molded portion of said earphone body.

4. The hanging type earphone as claimed in claim 1, wherein said polygonal prisms are integrally molded portions of said first connecting portion.

* * * * *

UNITED STATES PATENT AND TRADEMARK OFFICE

CERTIFICATE OF CORRECTION

PATENT NO. : 7,609,845 B2
APPLICATION NO. : 11/367478
DATED : October 27, 2009
INVENTOR(S) : Yu-Chao Chang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 905 days.

Signed and Sealed this

Twelfth Day of October, 2010

David J. Kappos

David J. Kappos
*Director of the United States Patent and Trademark Office*